US006540649B1

(12) United States Patent
Niedrich

(10) Patent No.: US 6,540,649 B1
(45) Date of Patent: Apr. 1, 2003

(54) EXERCISE APPARATUS AND KITS

(76) Inventor: Douglas Niedrich, P.O. Box 291, Hailey, ID (US) 83333

( * ) Notice: Subject to any disclaimer, the term of this patent is extended or adjusted under 35 U.S.C. 154(b) by 0 days.

(21) Appl. No.: 09/534,800

(22) Filed: Mar. 23, 2000

(51) Int. Cl.[7] ..... A63B 21/06; A63B 5/20

(52) U.S. Cl. ..... 482/82; 482/93; 482/109; 482/110

(58) Field of Search ..... 482/81, 82, 109, 482/110, 93, 94, 102, 105, 121, 126, 148; 446/26, 201, 215, 236, 247, 255, 266, 490; 463/47.2, 47.5; 473/212, 219, 228, 256, 424, 519, 576

(56) References Cited

U.S. PATENT DOCUMENTS

| | | | | | |
|---|---|---|---|---|---|
| 439,297 | A | * | 10/1890 | Heyder | 473/576 |
| 1,165,216 | A | * | 12/1915 | Weflen | 463/47.2 |
| 1,333,005 | A | * | 3/1920 | Warner | 482/110 |
| 3,428,325 | A | * | 2/1969 | Atkinson | 273/186 |
| 4,092,799 | A | * | 6/1978 | Anderson | 46/52 |
| 4,157,827 | A | * | 6/1979 | Winston et al. | 482/139 |
| 4,778,173 | A | * | 10/1988 | Joutras | 482/108 |
| 4,878,673 | A | * | 11/1989 | Pollard | 273/186 |
| 5,058,883 | A | * | 10/1991 | Dybvik | 272/93 |
| 5,092,583 | A | * | 3/1992 | Rudolf | 272/75 |
| 5,342,271 | A | * | 8/1994 | Long | 482/98 |
| 5,542,676 | A | * | 8/1996 | Howe, Jr. et al. | 473/202 |
| 5,842,956 | A | * | 12/1998 | Strachan | 482/82 |
| 5,895,341 | A | * | 4/1999 | Jones | 482/81 |
| 6,270,434 | B1 | * | 8/2001 | Shaw | 473/553 |

OTHER PUBLICATIONS

Cybex Strength Systems, 1995 brochure for VR2 line of equipment.*

* cited by examiner

*Primary Examiner*—Jerome W. Donnelly
*Assistant Examiner*—Victor Hwang
(74) *Attorney, Agent, or Firm*—Parsons & Golty; Robert A. Parsons; Michael W. Goltry

(57) ABSTRACT

Exercise apparatus comprising a lanyard having opposing ends, and a handle secured to one of the opposing ends and a device secured to the other one of the opposing ends, the device having a capacity to resist movement, the device capable of being set in motion in response to a force acting upon the handle.

8 Claims, 3 Drawing Sheets

EXERCISE APPARATUS AND KITS

FIELD OF THE INVENTION

This invention concerns exercise equipment and, more particularly, new and improved exercise apparatus and kits having component parts capable of being assembled into exercise apparatus.

BACKGROUND OF THE INVENTION

The combination of regular sleep, a proper diet and regular exercise is the formula for a healthy lifestyle. Proper exercise may include a combination of weight or resistance training, calisthenics and aerobic exercise such as running, biking, hiking, etc. Because exercise is an important component of a healthy lifestyle, skilled artisans devote considerable effort and resources toward the development of inexpensive and portable resistance and aerobic exercise equipment. To obviate the need to invest in expensive home exercise equipment and gym memberships, the advancement in inexpensive and portable exercise equipment is presently enjoying considerable industry-wide attention. In this regard, it would be highly desirable to provide improved exercise apparatus and kits having component parts capable of being assembled into exercise apparatus.

It is therefore a purpose of the invention to promote physical activity.

It is another purpose of the invention to provide new and improved exercise apparatus and kits that are easy to construct and safe to use.

It is still another purpose of the invention to provide new and improved exercise apparatus and kits that are portable and easy to assemble.

It is a further provision of the invention to provide new and improved exercise apparatus and kits that are inexpensive.

It is still a further provision of the invention to provide new and improved exercise apparatus and kits that facilitate resistance and aerobic exercise.

SUMMARY OF THE INVENTION

The above problems and others are at least partially solved and the above purposes and others realized in new and improved exercise apparatus. All and each of the ensuing embodiments of exercise apparatus may be provided as one or more kits of component parts capable of being assembled. In a specific embodiment, exercise apparatus of the invention comprises a lanyard having opposing ends, a handle secured to one of the opposing ends and a device secured to the other one of the opposing ends. The device has a capacity to resist movement and is capable of being set in motion in response movement of the handle. Also included is an associated monitor for monitoring at least one vital bodily function of a user acting upon the handle. The monitor includes a display for displaying sensible indicia of the at least one vital bodily function. In a particular embodiment, the device comprises a weight that includes a weight element encased substantially in a soft, resilient casing. In another embodiment, the device comprises an open framework supporting a fan blade. In a preferred embodiment, the handle is removably secured to the one of the opposing ends of the lanyard, and the device is removably secured to the other one of the opposing ends.

In another embodiment of the invention, proposed is exercise apparatus comprising first and second lanyards each having opposing ends, a first handle secured to one of the opposing ends of the first lanyard and a first device secured to the other one of the opposing ends of the first lanyard. The first device has a capacity to resist movement. A second handle is secured to one of the opposing ends of the second lanyard and a second device is secured to the other one of the opposing ends of the second lanyard. Like the first device, the second device has a capacity to resist movement. The first device is capable of being set in motion in response to movement of the first handle, and the second device is capable of being set in motion in response to movement of the second handle. Further provided is a flexible cord. The flexible cord has a first end secured to the first device and a second end secured to the second device. This embodiment includes an associated monitor for monitoring at least one vital bodily function of a user acting upon at least one of the first and second handles. The monitor includes a display for displaying sensible indicia of the at least one vital bodily function. In a specific embodiment, the first and second devices each comprise one of a weight and an open framework supporting a fan blade. Each weight preferably comprises a weight element encased substantially in a soft, resilient casing.

In yet another embodiment, the invention proposes exercise apparatus comprising a lanyard having opposing ends, a handle secured to one of the opposing ends of the lanyard and a device secured to the other one of the opposing ends of the lanyard. The device has a capacity to resist movement, and is capable of being set in motion in response to movement of the handle. Further provided is a handled lanyard having an end secured to the device. At least one of the lanyard and the handled lanyard is elastic. This embodiment further includes an associated monitor for monitoring at least one vital bodily function of a user acting upon the handle. The monitor includes a display for displaying sensible indicia of the at least one vital bodily function. In a particular embodiment, the device comprises a weight that includes a weight element encased substantially in a soft, resilient casing. The device may optionally comprise an open framework supporting a fan blade.

BRIEF DESCRIPTION OF THE DRAWINGS

The foregoing and further and more specific objects and advantages of the invention will become readily apparent to those skilled in the art from the following detailed description thereof taken in conjunction with the drawings in which.

DETAILED DESCRIPTION OF A PREFERRED EMBODIMENT

Figure 1:
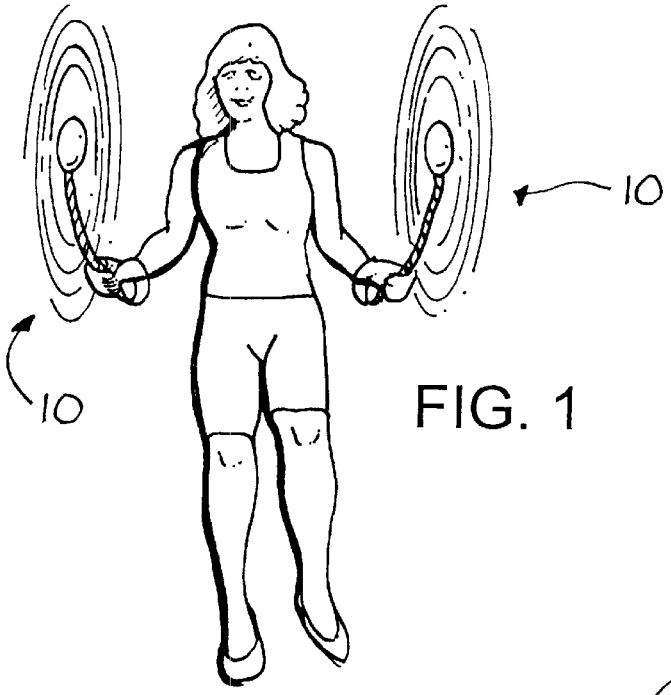
FIG. 1 illustrates two exercise apparatus of the invention each shown as it would appear in use during exercise.
Figure 2:
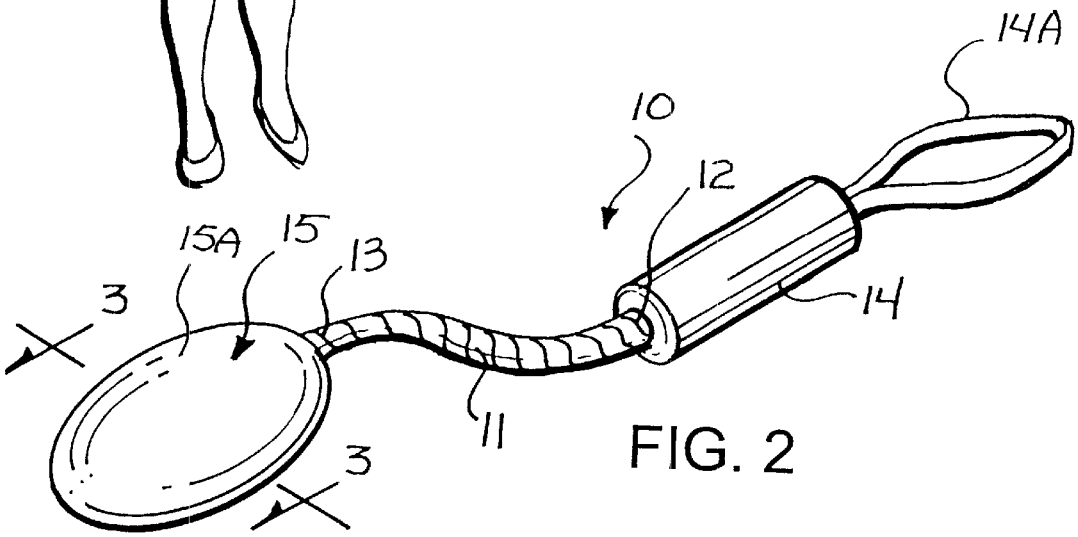
FIG. 2 is a perspective view of one of the exercise apparatus of FIG. 1, the exercise apparatus comprising a lanyard having a handle attached at one end and a device having a capacity to resist movement attached to another end.

The present invention provides, among other things, new and improved exercise apparatus. All and each of the ensuing embodiments of exercise apparatus may be provided as one or more kits of component parts capable of being assembled. Turning now to the drawings, in which like reference characters indicate corresponding elements throughout the several, views, FIG. 1 illustrates two exercise apparatus 10 each shown as it would appear in use during exercise and constructed in accordance with a preferred embodiment of the invention. Regarding FIG. 2, exercise apparatus 10 comprises a lanyard 11 having opposing ends 12 and 13, a handle 14 secured to end 12 and a device 15 secured to end 13. Lanyard 11 is elongate and constructed of nylon or cotton ropes or other similar flexible and resilient material. Lanyard 11 may be constructed of an elastic material if desired. Device 15 is capable of being set in motion in response to movement of handle 14. To employ each apparatus 10, a user may hold each handle 14 in one of her hands and then, by acting on each handle 14, twirl or move each device 15 in a substantially circular or curvilinear pattern. By repeatedly jumping while twirling, the user can mimic a jump rope exercise without actually having to jump over a rope. Handle 14 is provided with a wrist strap 14A for added comfort and for preventing handle 14 from slipping away during use.

Figure 3:
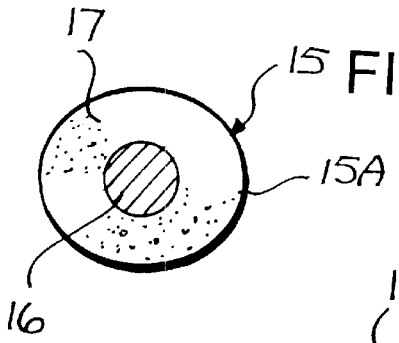
FIG. 3 is a sectional view taken along line 3—3 of FIG. 2.

Device 15 has a capacity to resist movement, which provides a level of resistance during exercise. In a preferred embodiment, device 15 comprises a weight 15A. Regarding FIG. 3 illustrating a sectional view taken along line 3—3 of FIG. 2, weight 15A preferably comprises a weight element 16 encased substantially in a soft, resilient casing 17. Weight element 16 may include water or other viscous liquid, a weighted medium such as shot, sand or the like, a unitary element constructed of steel or the like, etc. Casing 17 can be provided of any suitable thickness. In a specific embodiment, casing 17 is constructed of foam or other resilient material having a vinyl, rubber, rubber-like or other similar exterior cover or shell. Casing 17 protects a user from becoming injured if weight 15A should hit a body part. Also, a user may grasp weight 15A with her or her hand and then massage it, which provides a hand-strengthening exercise. Although weight 15A is rounded or oval-shaped, it may be provided in any desired shape. Should the weight element 16 comprise shot, casing 17 may, in another embodiment, comprise only a thin, flexible resilient shell. Weight element 16 may be arranged in such a way so that it can be varied and/or replaced as needed.

Figure 8:
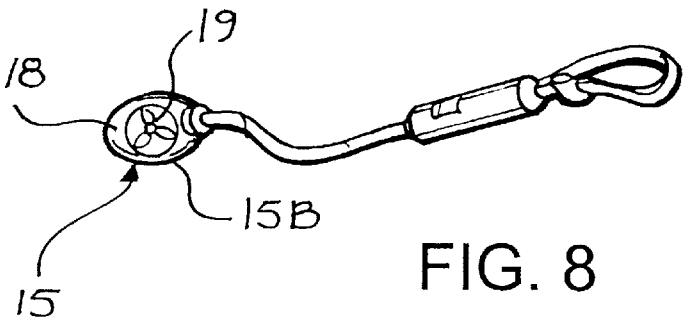
FIG. 8 illustrates an open framework supporting a fan blade.

Turning momentarily to FIG. 8, shown is a fan structure 15B in accordance with another embodiment of device 15. In FIG. 8, fan structure 15B is comprised of an open framework 18 supporting a fan blade 19 for free rotation. As open framework 18 is moved through space, the passing air will cause fan blade 19 to rotate and move, which provides a level of resistance to movement. As fan structure 15B moves through space and fan blade 19 rotates, fan blade 19 will make a whirring sound. The pitch of the whirring sound varies and actually increases the faster fan structure 15B is moved through the air. This is important, as it provides an audible indication of how fast fan structure 15B is being moved. By focusing attention on the pitch of the whirring sound, a user may gauge and vary his or her level of exercise output.

Figure 4:
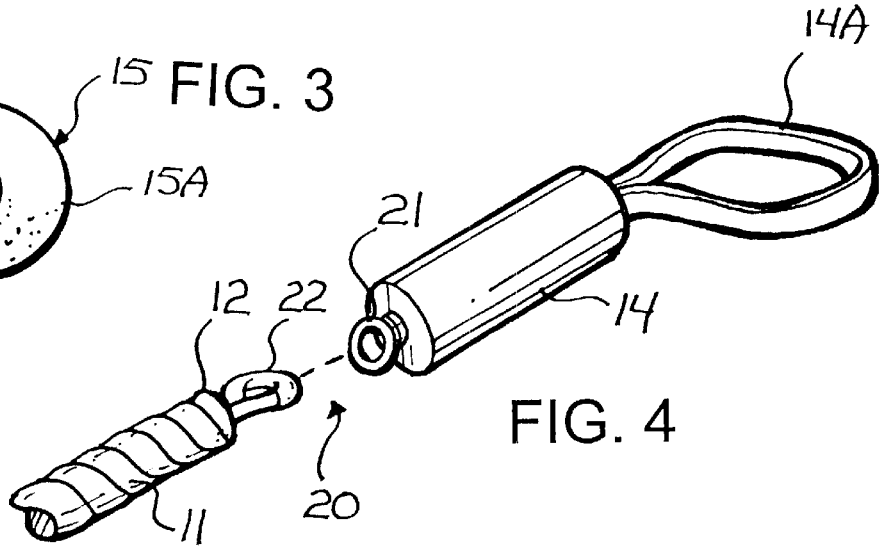
FIG. 4 is a perspective view of an assembly for removably securing the lanyard of FIG. 2 to the handle.

Handle 14 and device 15 are preferably removably secured to ends 12 and 13 of lanyard 11, respectively. To provide a secured and detachable engagement between handle 14 and end 12 and between device 15 and end 13, the pair comprising handle 14 and end 12 and the pair comprising device 15 and end 13 may each be equipped with an engagement assembly such as a male/female threaded engagement assembly, a clasp assembly, a ball joint engagement assembly or any other suitable engagement structure. FIG. 4 illustrates an example of a clasp assembly 20, which comprises an eyelet 21 carried by handle 14 and a detachably engagable clasp 22 carried by end 12 of lanyard 11. The positioning of eyelet 21 and clasp 22 may be reversed if desired.

Figure 5:
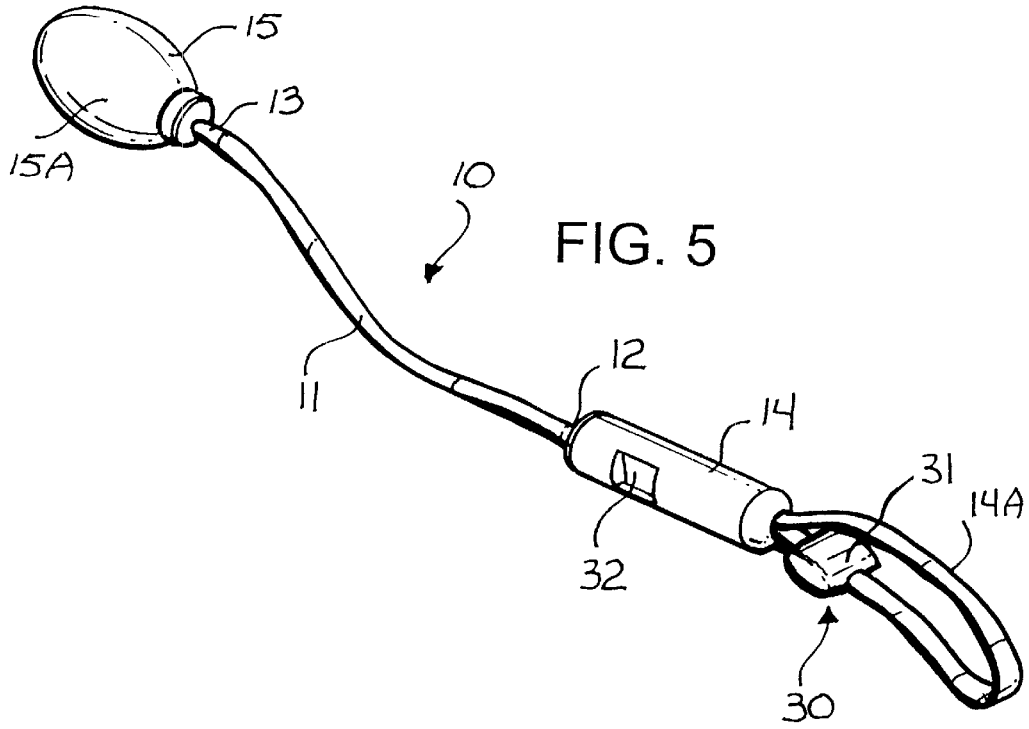
FIG. 5 is a perspective view of the exercise apparatus of FIG. 2 shown equipped with a monitor for monitoring at least one bodily function of a user acting on the handle.

Turning to FIG. 5, handle 14 is shown as it would appear equipped with a monitor 30. Monitor 30 is of a conventional type capable of monitoring at least one vital bodily function of a user holding or otherwise acting on handle 14 with one of her hands. The vital bodily function may comprise heart rate, body temperature or other vital bodily function that can be measured at or adjacent the hand and/or wrist. The electrical components and associated power source of monitor 30 are preferably contained by handle 14. Monitor 30 includes a sensor 31 for sensing at least one bodily function and a display 32 for displaying sensible indicia of the at least one vital bodily function. The sensible indicia may comprise any numbering, lettering and/or symbology representation capable of being perceived and understood. Sensor 31 is shown carried by strap 14A, but it may be carried directly by handle 14 if so desired. Furthermore, display 32, which may comprise an LED display or other form of electronic display, is shown supported by handle 14. In the embodiment shown in FIG. 5, it is intended that strap 14A be positioned about the wrist of the user so that sensor 31 engages the user's hand and/or wrist. In an alternate embodiment, monitor 30 may be equipped with the capacity to emit an audible, sensible stimulus of a sensed vital bodily function. Monitor 30 may also be configured with a timer, an alarm, a cadence monitor or counter, a calories burned output, etc.

Figure 6:
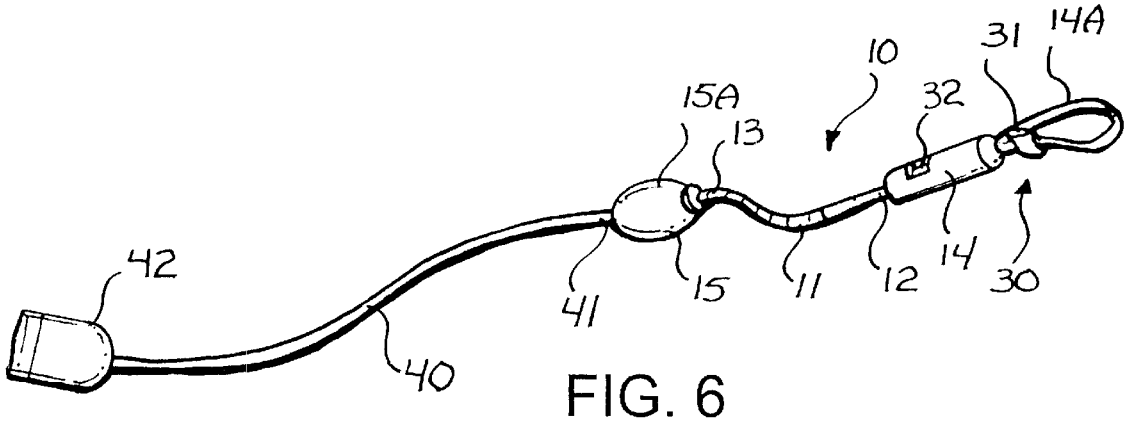
FIG. 6 is a perspective view of the exercise apparatus of FIG. 2 having an attached handled lanyard.
Figure 7:
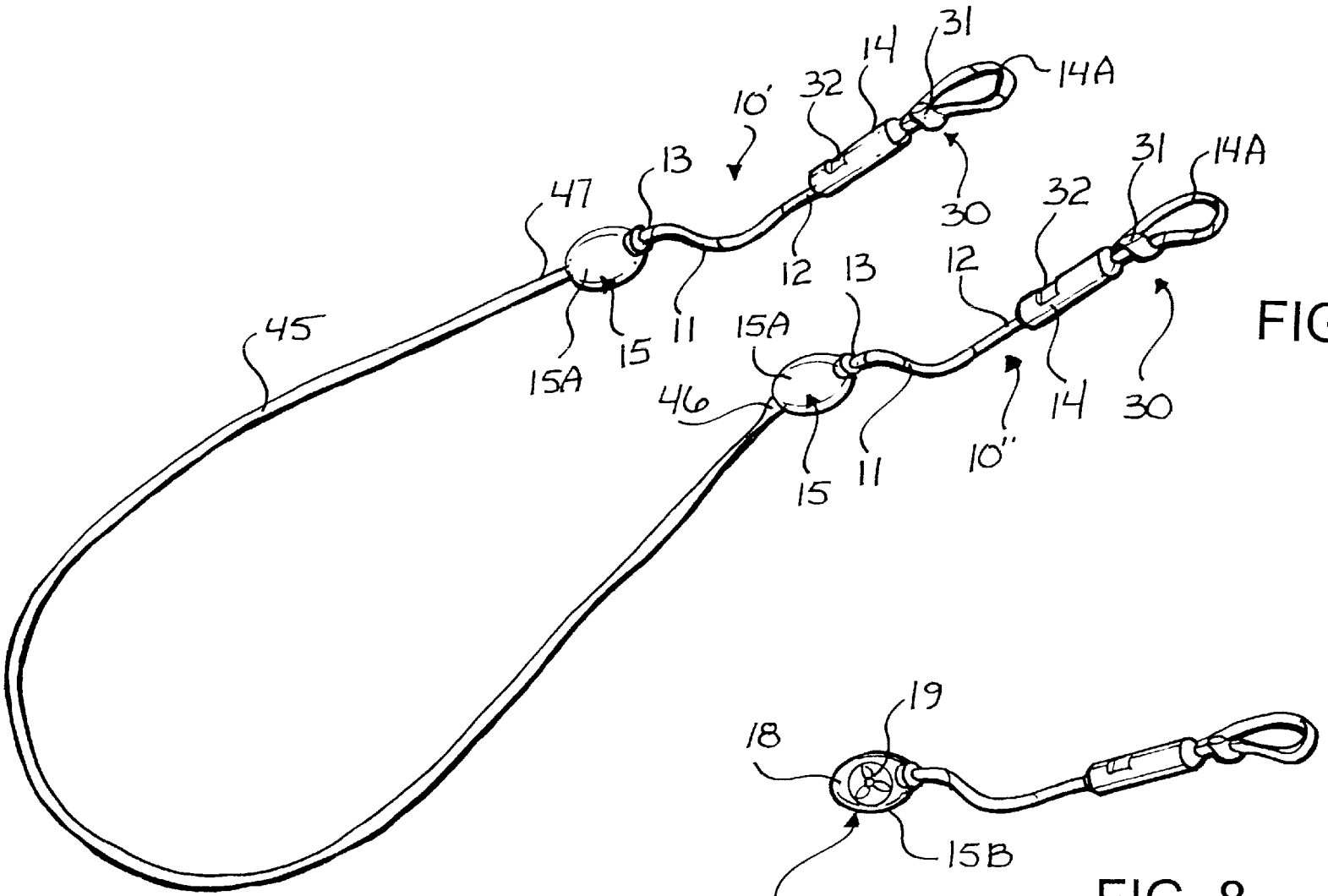
FIG. 7 is a perspective view of a flexible cord secured to two exercise apparatus each like that shown in FIG. 2.

The invention may also be provided with additional detachable accessories such as a handled lanyard 40 shown in FIG. 6 and a flexible cord 45 shown in FIG. 7. Regarding FIG. 6, handled lanyard 40 is elongate and is shown having an end 41 secured to device 15 and an opposing handled free end 42. To provide a secured and detachable engagement between handled lanyard 40 and device 15, end 41 and device 15 may be equipped with an engagement assembly such as a male/female threaded engagement assembly, a clasp assembly, a ball joint engagement assembly or any other suitable engagement structure. Handled lanyard 40 is preferably constructed of a flexible, elastic cord or tubing. When engaged to device 15, a user may thus employ handled free end 42 and handle 14 for resistance training exercise by repeatedly stretching handled free end 42 and handle apart.

Regarding FIG. 7, flexible cord 45 is elongate and is shown having an end 46 secured to device 15 of a first apparatus 10' and an end 47 secured to device 15 of a second apparatus 10". This structural assembly provides exercise apparatus that may be employed for a normal jump rope exercise. In this regard, by gripping handles 14 of each apparatus 10' and 10", a user may jump rope in a conventional manner, with device 15 of each apparatus 10' and 10" providing a desired resistance. To provide a secured and detachable engagement between ends 46 and 47 and.each device 15 of each apparatus 10' and 10", ends 46 and 47 and each device 15 may be equipped with an engagement assembly such as a male/female threaded engagement assembly, a clasp assembly, a ball joint engagement assembly or any other suitable engagement structure.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Exercise apparatus comprising:

first and second lanyards each having opposing ends;

a first handle secured to one of the opposing ends of the first lanyard and a first device secured to the other one of the opposing ends of the first lanyard, the first device capable of being set in motion in response to movement of the first handle and having a capacity to resist movement, the first device including a weight element encased substantially in a soft, resilient casing and a first releasable engagement assembly for engagingly receiving a first accessory device positioned in substantial opposition to the first lanyard; and a second handle secured to one of the opposing ends of the second lanyard and a second device secured to the other one of the opposing ends of the second lanyard, the second device capable of being set in motion in response to movement of the second handle and having a capacity to resist movement, the second device including a weight element encased substantially in a soft, resilient casing and a second releasable engagement assembly for engagingly receiving a second accessory device positioned in substantial opposition to the second lanyard.

2. Exercise apparatus of claim 1, further including an associated monitor for monitoring at least one vital bodily function of a user acting upon at least one of the first and second handles.

3. Exercise apparatus of claim 2, wherein the monitor includes a display for displaying sensible indicia of the at least one vital bodily function.

4. Exercise apparatus of claim 1, further including a flexbile cord having a first end removably securable to the first device and a second end removably securable to the second device.

5. A kit having component parts capable of being assembled into exercise apparatus, the kit comprising:

first and second lanyards each having opposing ends;

a first handle adapted to be secured to one of the opposing ends of the first lanyard;

a first device adapted to be secured to the other one of the opposing ends of the first lanyard, the first device having a capacity to resist movement and including a weight element encased substantially in a soft, resilient casing and a first releasable engagement assembly for engagingly receiving a first accessory device positioned in substantial opposition to the first lanyard;

a second handle adapted to be secured to one of the opposing ends of the second lanyard;

a second device adapted to be secured to the other one of the opposing ends of the second lanyard, the second device having a capacity to resist movement and including a weight element encased substantially in a soft, resilient casing and a second releasable engagement assembly for engagingly receiving a second accessory device positioned in substantial opposition to the second lanyard; and the first accessory device and the second accessory device selected from a group consisting of jump ropes and resistance training apparatus.

6. The kit of claim 5, further including an associated monitor for monitoring at least one vital bodily function of a user acting upon at least one of the first and second handles.

7. The kit of claim 6, wherein the monitor includes a display for displaying sensible indicia of the at least one vital bodily function.

8. The kit of claim 5 further including a flexible cord having a first end adapted to be secured to the first device and a second end adapted to be secured to the second device.

* * * * *